US008449436B2

(12) United States Patent
Chuang et al.

(10) Patent No.: US 8,449,436 B2
(45) Date of Patent: May 28, 2013

(54) WRIST EXERCISER WITH HANDLE

(75) Inventors: Pei Sung Chuang, Taipei County (TW); Yun Yu Chuang, Taipei County (TW)

(73) Assignee: Nano-Second Technology Co., Ltd., Taipei County (TW)

( * ) Notice: Subject to any disclaimer, the term of this patent is extended or adjusted under 35 U.S.C. 154(b) by 431 days.

(21) Appl. No.: 12/917,169

(22) Filed: Nov. 1, 2010

(65) Prior Publication Data

US 2012/0077643 A1 Mar. 29, 2012

(30) Foreign Application Priority Data

Sep. 29, 2010 (TW) ..... 99218811 U

(51) Int. Cl.
*A63B 23/14* (2006.01)
*A63B 23/16* (2006.01)
*A63B 21/22* (2006.01)

(52) U.S. Cl.
USPC ..... 482/44; 482/45; 482/49; 482/110

(58) Field of Classification Search
USPC ..... 482/1–2, 44–50, 92, 97, 106–110, 482/902; 601/23, 33, 40; 446/233–236, 242, 446/248–249; D21/662, 684
IPC ..... A63B 21/22,23/14, 23/16
See application file for complete search history.

(56) References Cited

U.S. PATENT DOCUMENTS

| | | | | |
|---|---|---|---|---|
| D350,796 | S | 9/1994 | Pravitz | |
| D351,436 | S | 10/1994 | Pravitz | |
| D351,437 | S | 10/1994 | Pravitz | |
| D365,612 | S | 12/1995 | Pravitz | |
| D381,719 | S | 7/1997 | Pravitz | |
| D418,562 | S | 1/2000 | Pravitz et al. | |
| 6,053,846 | A * | 4/2000 | Lin | 482/44 |
| 7,102,258 | B2 * | 9/2006 | Shen | 310/50 |
| 7,326,156 | B2 * | 2/2008 | Dworzan | 482/110 |
| 7,563,210 | B2 * | 7/2009 | Smith | 482/110 |
| 2003/0134727 | A1 | 7/2003 | Yu | |
| 2004/0102290 | A1 | 5/2004 | Holzman | |
| 2005/0006961 | A1 | 1/2005 | Shen | |
| 2005/0107218 | A1 | 5/2005 | Chuang et al. | |
| 2006/0189444 | A1 * | 8/2006 | Van Ophoven | 482/35 |

FOREIGN PATENT DOCUMENTS

| | | | |
|---|---|---|---|
| DE | 20208746 | U1 | 10/2002 |
| EP | 2021082 | A1 | 2/2009 |
| GB | 2429176 | A | 2/2007 |

* cited by examiner

*Primary Examiner* — Oren Ginsberg
(74) *Attorney, Agent, or Firm* — Morris Manning & Martin LLP; Tim Tingkang Xia, Esq.

(57) ABSTRACT

A wrist exerciser with a handle and multiple hold positions includes a first exercise ball body and a handle. The first exercise ball body has a first opening, a rotor, and a first hold position for driving the rotor to rotate. The first opening is disposed at a side of the first exercise ball body. The rotor is disposed inside the first exercise ball body. The handle is connected to the other side of the first exercise ball body where the first opening is disposed. The handle is coaxially corresponding to the first opening, and has a second hold position for driving the rotor to rotate, so as to provide multiple hold modes for a user to carry out wrist exercise modes of different postures, thereby increasing interests and enhancing comprehensiveness of forearm muscle exercises.

10 Claims, 7 Drawing Sheets

WRIST EXERCISER WITH HANDLE

CROSS-REFERENCE TO RELATED APPLICATIONS

This non-provisional application claims priority under 35 U.S.C. §119(a) on Patent Application No(s). 099218811 filed in Taiwan, R.O.C. on Sep. 29, 2010, the entire contents of which are hereby incorporated by reference.

BACKGROUND OF THE INVENTION

1. Field of Invention

The present invention relates to a wrist exerciser with a handle, and more particularly to a wrist exerciser with a handle that has multiple hold positions.

2. Related Art

A conventional wrist exercise ball comprises an upper case body and a lower case body. The upper case body and the lower case body are combined to wrap a rotating sphere, so as to accommodate the rotating sphere inside the upper case body and the lower case body. A top of the upper case body has an opening to expose a part of the rotating sphere. The rotating sphere has a rotating shaft at both ends respectively, and the two rotational axes are pivoted to an outer ring. The outer ring at least has one elastic device. A movable arm mechanism is at least disposed in a side surface of the rotating sphere corresponding to the elastic device, and the movable arm mechanism is used to connect the elastic device. The rotating sphere is partially rotated, or contacts with a surface of an object and is dragged along a straight line, so that the elastic device accumulates elasticity of compression. After the rotating sphere is released, the rotating sphere generates an auxiliary power and an initial rotating speed for starting reverse rotation through the elasticity released by the elastic device, and the movable arm mechanism is separated from the elastic device through a rotating centrifugal force.

However, in most cases, in the conventional wrist exercise ball, an anti-slip strip is disposed at a connection position between the upper case body and the lower case body, so that a user can hold the wrist exercise ball for performing wrist movement. In addition, no other hold modes exist in such structure design of the conventional wrist exercise ball. Thus, for the user using the wrist exercise ball, not only the monotonous hold mode makes the user being apt to feel boring, but also the same hold posture causes fatigue of the same muscle during the movement.

Another modified wrist exercise ball has a data transmission function, and can detect a rotating speed of the rotating sphere and transmit the rotating speed to an external device. In addition to having the structure of the wrist exercise ball as described above, the modified wrist exercise ball further comprises a transmission device and a transmission cable. The transmission device is connected to a bottom of the lower case body of the wrist exercise ball, and comprises a sensor and a data processing circuit. The sensor is used to sense the rotating speed of the rotating sphere inside the upper and lower case bodies of the wrist exercise ball, and transmits sense signals to the data processing circuit. The data processing circuit performs counting and operates an actual rotating speed, and finally outputs movement data information according to a rotation times and an operational result of the rotating speed. One end of the transmission cable is connected to the data processing circuit, and the other end is connected to a data Terminal Equipment (TE), such as a computer and a cell phone, so that the movement data information can be transmitted to the data TE, for allowing the data TE to store, display, or apply the movement data information.

However, since the transmission device is limited to a space of the bottom of the exercise ball, the transmission device needs to be connected to the external device via the transmission cable, so to store, display, or apply the movement data information, which is very inconvenient in using.

SUMMARY OF THE INVENTION

Accordingly, the present invention is a wrist exerciser with a handle that has multiple hold positions, in which an additional handle structure capable of being disassembled from/assembled on a conventional wrist exercise ball without increasing usage complexity and a production cost, thereby solving foregoing mentioned problems that a user is apt to feel boring or the same hold posture causes fatigue of the same muscle during the movement due to the single hold position.

The present invention provides a wrist exerciser with a handle, which comprises a first exercise ball body and a handle. The first exercise ball body has a first opening, a rotor, and a first hold position for driving the rotor to rotate. The first opening is disposed at a side of the first exercise ball body. The rotor is disposed inside the first exercise ball body. The handle is connected to the other side of the first exercise ball body on which the first opening is disposed. The handle is coaxially corresponding to the first opening, and has a second hold position for driving the rotor to rotate.

The wrist exerciser with the handle in accordance with the present invention has a first hold position and a second hold position, so as to provide multiple hold modes for a user to carry out wrist exercise modes of different postures, thereby increasing interests and enhancing comprehensiveness of forearm muscle exercises.

Further, in the present invention, different members are movably disassembled from or assembled on both ends of the handle, so as to improve functionality, practicability, and entertainment of the present invention. In an embodiment of the present invention, a base body is added, and an electronic module and an output module are disposed in the base body, for directly storing, displaying, or applying the movement data information, thereby improving the functionality and the practicability. In another embodiment of the present invention, another second exercise ball body is added on the other end of the handle where the first exercise ball body is disposed. The structure of the second exercise ball body is the same as that of the first exercise ball body, which both with an opening and a rotor. When the user rotates his/her wrist to drive the rotor of the first exercise ball body, the rotor of the second exercise ball body is also driven to rotate, so that the entertainment is improved.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
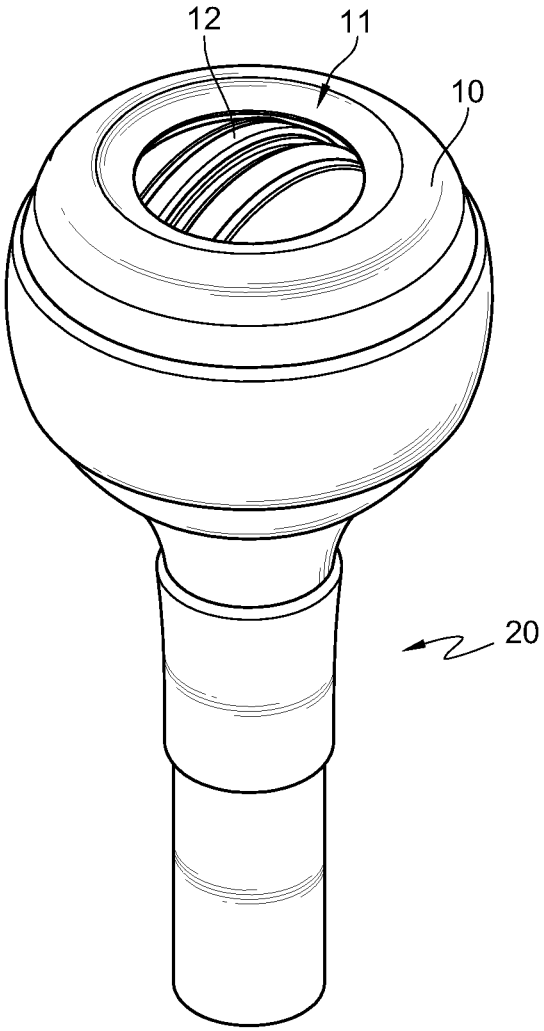
FIG. 1 is a schematic view of an embodiment of a wrist exerciser with a handle according to the present invention.
Figure 2:
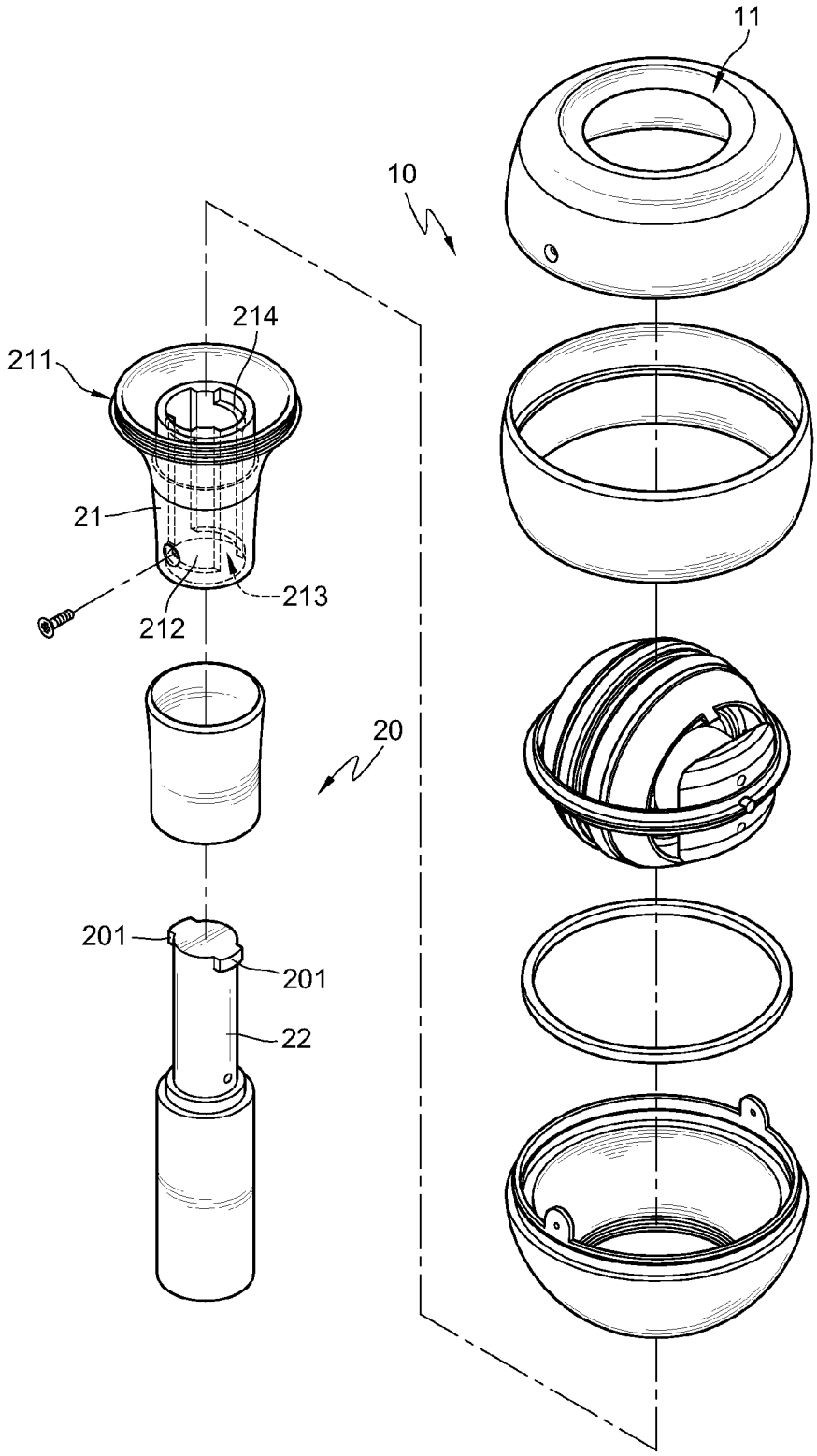
FIG. 2 is an exploded view of the wrist exerciser with the handle in FIG. 1.

Referring to FIG. 1 and FIG. 2, FIG. 1 is a schematic view of an embodiment of a wrist exerciser with a handle according to the present invention, and FIG. 2 is an exploded view of the wrist exerciser with the handle in FIG. 1. The wrist exerciser with the handle according to the present invention comprises a first exercise ball body 10 and a handle 20. The first exercise ball body 10 has a first opening 11, a rotor 12, and a first hold position for driving the rotor to rotate. The first opening 11 is disposed at a side of the first exercise ball body 10. The rotor 12 is disposed inside the first exercise ball body 10. The handle 20 is connected to the other side of the first exercise ball body 10 where the first opening 11 is disposed. The handle 20 is coaxially corresponding to the first opening 11, and has a second hold position for driving the rotor 12 to rotate.

Figure 3:
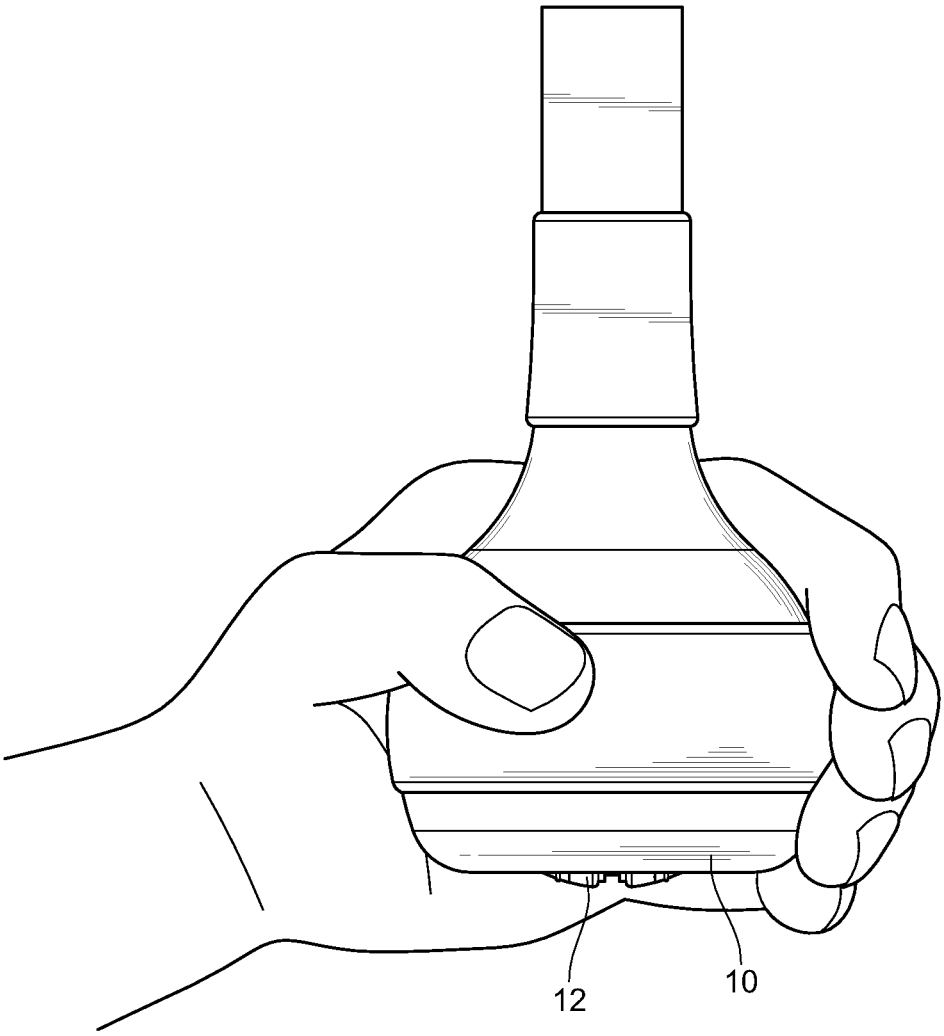
FIG. 3 is a schematic view of holding a first hold position of the present invention by a user.
Figure 4:
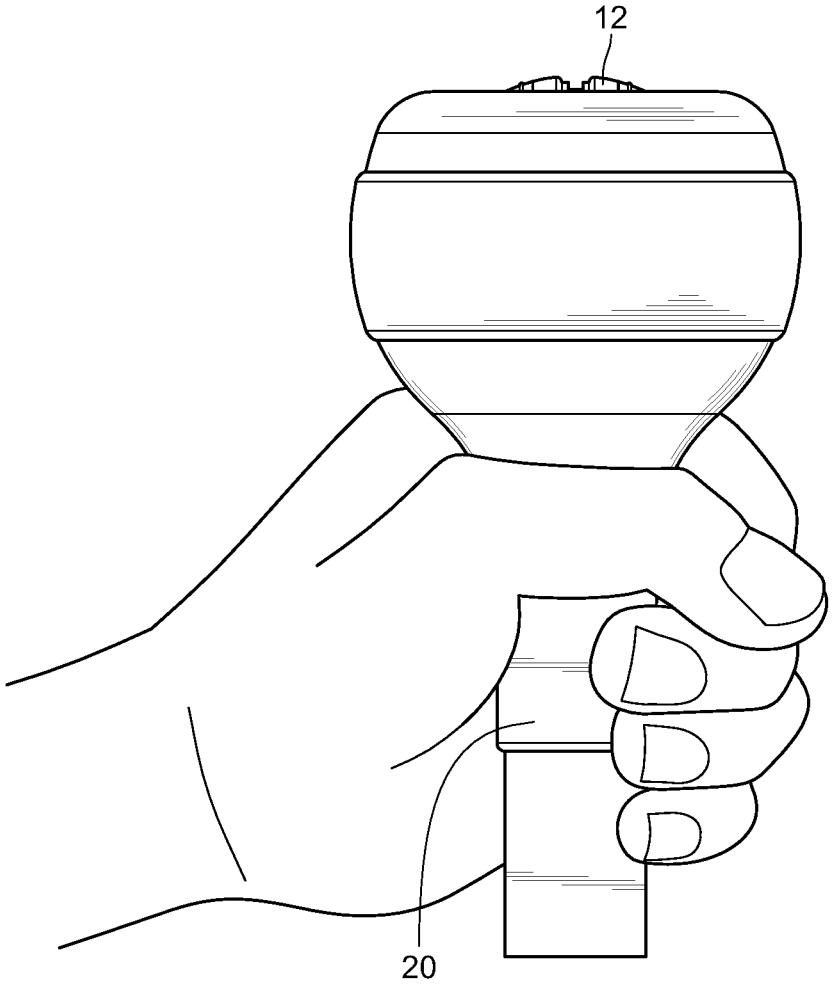
FIG. 4 is a schematic view of holding a second hold position of the present invention by a user.

Therefore, referring to FIG. 3 and FIG. 4, FIG. 3 is a schematic view of holding a first hold position of the present invention by a user, and FIG. 4 is a schematic view of holding a second hold position of the present invention by a user. When carrying out wrist exercises by using the first hold position, the user uses the first exercise ball body 10 as a main holding portion, and drives the rotor 12 to rotate by using the first exercise ball body 10 as a fulcrum. As shown in FIG. 4, when carrying out wrist exercises by using the second hold position, the user uses the handle 20 as the main holding portion, and drives the rotor 12 to rotate by using the handle 20 as a fulcrum. The first hold position and the second hold position may enable the user to exercise different parts of forearm muscles when rotating his/her wrist.

The handle 20 may be integrally formed on the first exercise ball body 10, or the handle 20 has a screw-tooth structure (not shown) at a position connected to the first exercise ball body 10, the first exercise ball body 10 has a screw-thread structure (not shown), and the screw-tooth structure (not shown) is screwed with the screw-thread structure (not shown), so that the handle 20 is firmly disposed at the first exercise ball body 10.

Referring to FIG. 2, in an embodiment of the present invention, the handle 20 comprises a first connection member 21 and a plunger 22. The first connection member 21 comprises a first connection portion 211 and a first locking portion 212. The first connection portion 211 is connected to the other side of the first exercise ball body 10 where the first opening 11 is disposed. The plunger 22 has a top and a bottom. The top is inserted to the first connection portion 211, and is firmly combined with the first locking portion 212. An edge of the top of the plunger 22 has two outward protrusions 201. The first locking portion 212 has two longitudinal guide rails 213 corresponding to the two outward protrusions 201, and two grooves 214 facing with each other and disposed between the two longitudinal guide rails 213. The corresponding protrusion 201 is inserted to each longitudinal guide rail 213, so that the two protrusions 201 are snapped in the grooves 214 from a bottom of the first locking portion 212 through the longitudinal guide rails 213.

However, it should be noted that a connection relation that the plunger 22 is snapped in the first locking portion 212 is just an embodiment of the present invention, which is not intended to limit the present invention. The connection means can be easily replaced by other technical means, for example, the plunger 22 can be locked on the first locking portion 212 by simply using a screw.

Figure 5A:
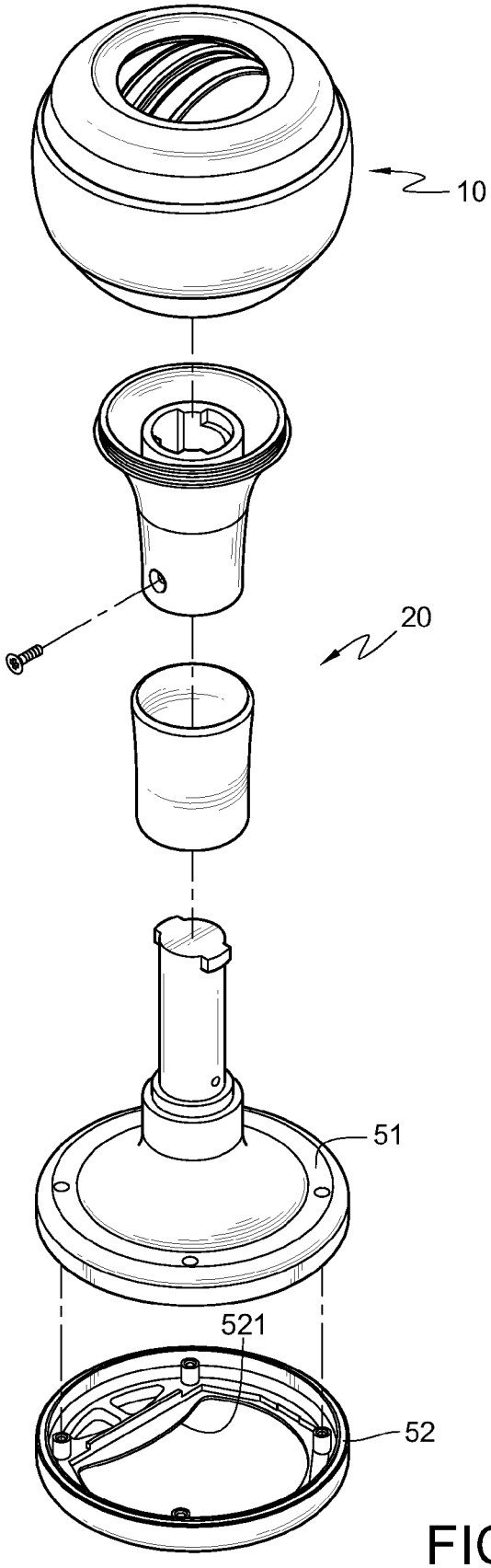
FIG. 5A is a schematic view of an embodiment of a wrist exerciser with a handle according to the present invention.
Figure 5B:
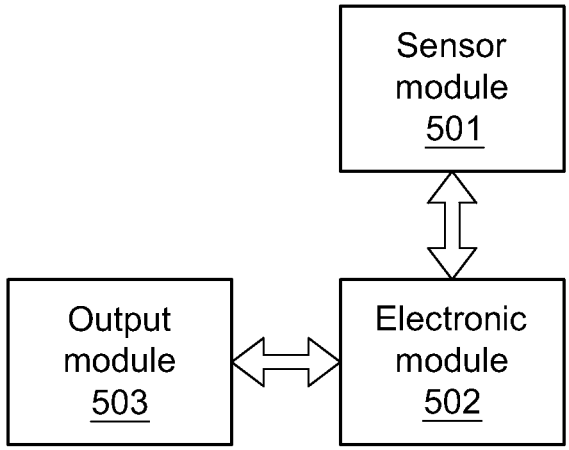
FIG. 5B is a functional block diagram of a sensor module, an electronic module, and an output module according to the present invention.

Referring to FIG. 5A and FIG. 5B, FIG. 5A is a schematic view of an embodiment of a wrist exerciser with a handle according to the present invention, and FIG. 5B is a functional block diagram of a sensor module, an electronic module, and an output module in accordance with the present invention. In this embodiment, the present invention further comprises a sensor module 501, a base body 51, an electronic module 502, and an output module 503. The sensor module 501 is disposed at the first exercise ball body 10 for sensing a rotating status of the rotor 12 inside the first exercise ball body 10, in which the status comprises a rotating speed and a rotation times. The sensor module 501 outputs movement data information according to a sensing result, and sends the movement data information to the electronic module 502 in a wired or wireless transmission mode. The base body 51 is connected to the other end of the handle 20 where the first exercise ball body 10 is disposed. The base body 51 has a cover body 52 having a hollow window 521. An accommodation space is formed inside the cover body 52 and the base body 51, and the electronic module 502 is disposed inside the accommodation space. The output module 503 is embedded on the hollow window 521, and is electrically connected to the electronic module 502. After receiving the movement data information from the sensor module 501, the electronic module 502 transmits the movement data information to the output module 503. In this embodiment, both the sensor module 501 and the electronic module 502 have a transmission interface (such as RS232) of a sequence data communication protocol for performing wired transmission of the movement data information.

Figure 5C:
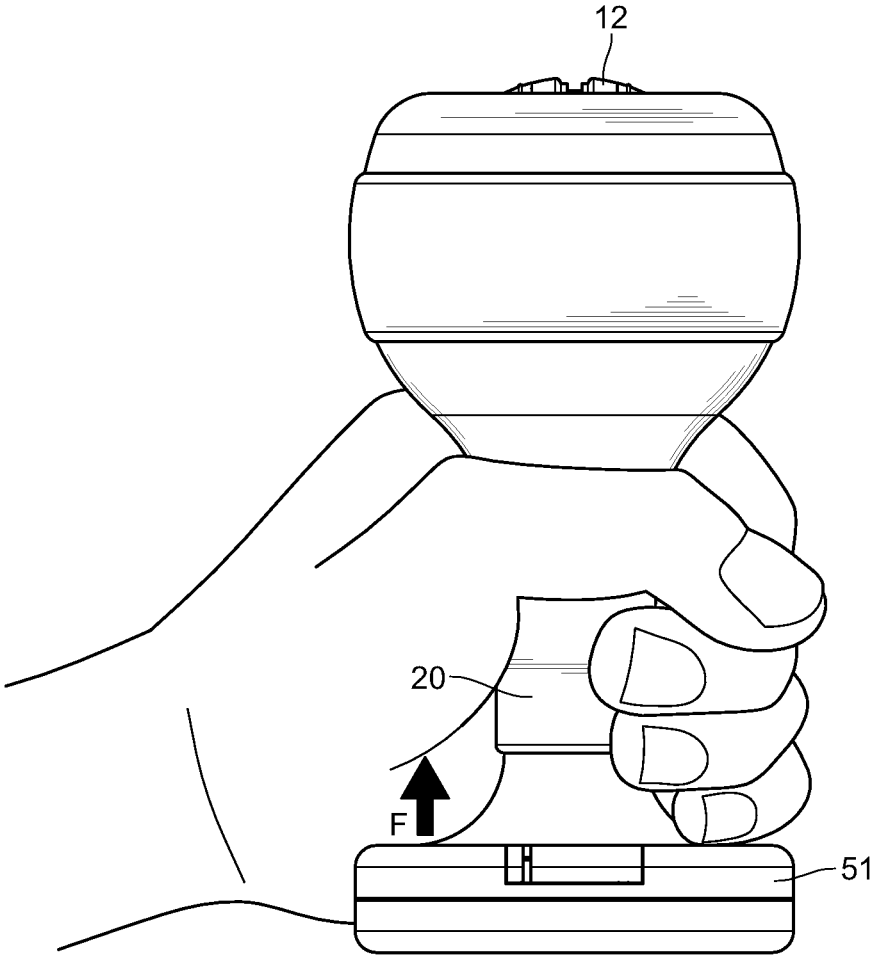
FIG. 5C is a schematic view of holding the wrist exerciser in the embedment of FIG. 5A at a second hold position by a user.

Referring to FIG. 5C, it is a schematic view of holding the wrist exerciser in the embedment of FIG. 5A at a second hold position by a user. When the user carries out the wrist exercises by holding the second hold position, the base body 51 provides a support force F for the user, so that the user can firmly hold the wrist exerciser, thereby avoiding the first exercise ball body 10 from being damaged after the wrist exerciser is loosed from the hand when the user uses the wrist exerciser too fiercely.

In this embodiment, the output module 503 is a display panel. The electronic module 502 comprises a processing unit and a power unit. After storing, processing, and operating the received movement data information, the processing unit transmits the movement data information to the output module 503, such that the movement data information is presented to the user in an on-screen display mode. The power unit has a cell for supplying power to the output module 503, the electronic module 502, the sensor module 501, or other required elements to be driven by power. However, the output module 503 being the display panel in this embodiment is only used for illustration, but is not used to limit the present invention. The output module may also be a buzzer, a vibrator, or an equivalent combination.

In addition, the electronic module 502 has a transmission module capable of exchanging data with an external data TE (such as a personal computer, a notebook computer, or a cell phone). The transmission module may send the movement data information to the external data TE in the wired or wireless transmission mode. The transmission module comprises but is not limited to a Universal Serial Bus (USB) transmission module, an Ethernet transmission module, an Institute of Electrical and Electronics Engineers 802 (IEEE 802) standard wireless transmission module, Zigbee or Bluetooth transmission module.

Figure 6:
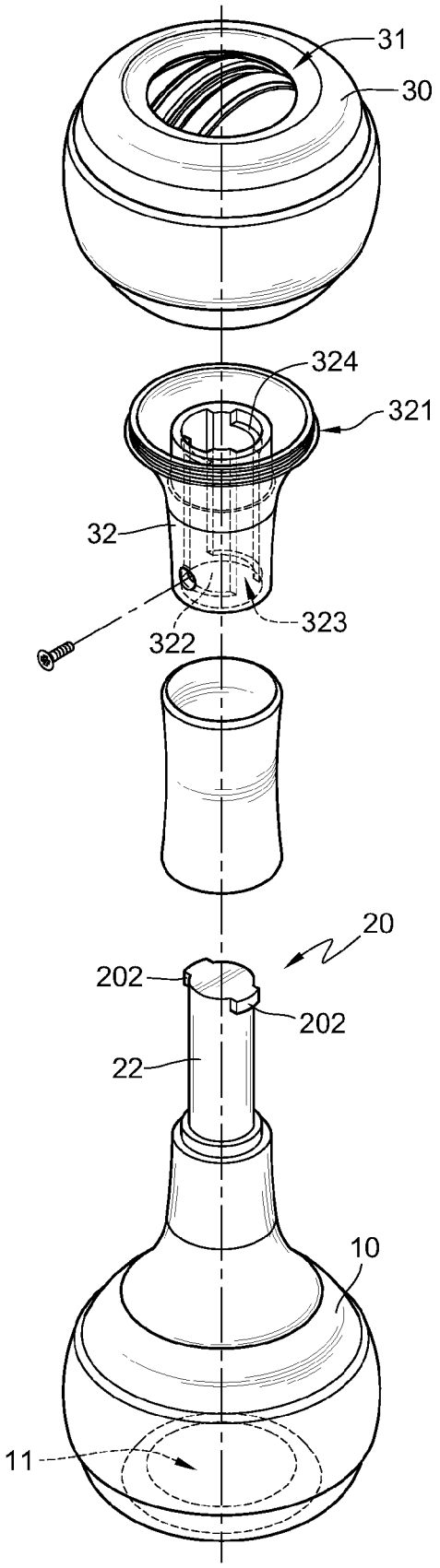
FIG. 6 is a schematic view of an embodiment of a wrist exerciser with a handle according to the present invention.

Referring to FIG. 6, it is a schematic view of an embodiment of a wrist exerciser with a handle according to the present invention. The difference between this embodiment and the embodiment in FIG. 5A lies in that a second exercise ball body 30 is disposed at the handle 20 on which the base body is originally disposed. The second exercise ball body 30 has a second opening 31 and a rotor 32. The second opening 31 is disposed at a side of the second exercise ball body 30, and the other side of the second exercise ball body 30 is connected to an end of the handle 20 where the first exercise ball body 10 is disposed. It should be noted that the first opening 11 is coaxially corresponding to the second opening 31.

In this embodiment, the wrist exerciser according to the present invention further comprises a second connection member 32 for connecting the second exercise ball body 30 and the handle 20. The second connection member 32 comprises a second connection portion 321 and a second locking portion 322. The second connection portion 321 is connected to the side of the second exercise ball body 30 where the second opening 31 is disposed. The bottom of the plunger 22 is inserted to the second connection portion 321, and is firmly combined with the second locking portion 322. The edge of the bottom of the plunger 22 has two outward protrusions 202. The second locking portion 322 has two longitudinal guide rails 323 corresponding to the two outward protrusions 202, and two grooves 324 facing each other and disposed between the two longitudinal guide rails 323. The corresponding protrusion 202 is inserted to each longitudinal guide rail 323, so that the two protrusions 202 are snapped in the grooves 324 from the bottom of the second locking portion 322 through the longitudinal guide rails 323.

Based on the above, through the structure of the present invention, the user may select the hold mode according to the different hold positions (the first hold position and the second hold position), thus exercising the forearm muscles. In addition, the base body or the second exercise ball body may be correspondingly disposed at the end of the handle other than the end on which the first exercise ball body is disposed according to demands or favors, thereby improving functionality, practicability, and entertainment of the present invention.

What is claimed is:

1. A wrist exerciser with a handle, comprising:

a first exercise ball body, having a first opening, a rotor, and a first hold position driving the rotor to rotate, wherein the first opening is disposed at a side of the first exercise ball body, and the rotor is disposed inside the first exercise ball body;

a handle, connected to the other side of the first exercise ball body where the first opening is disposed, being coaxially corresponding to the first opening, and having a second hold position driving the rotor to rotate; the handle comprises: a first connection member, comprising a first connection portion and a first locking portion, wherein the first connection portion is connected to the other side of the first exercise ball body other than the side on which the first opening is disposed, and a plunger, having a top and a bottom, wherein the top is inserted to the first connection portion, and is firmly combined with the first locking portion, an edge of the top of the plunger has two outward protrusions, the first locking portion has two longitudinal guide rails corresponding to the two protrusions, and two grooves facing each other and disposed between the two longitudinal guide rails, and a corresponding protrusion is inserted to each longitudinal guide rail, so that the two protrusions are snapped in the two grooves from a bottom of the first locking portion through the two longitudinal guide rails.

2. The wrist exerciser with the handle according to claim 1, further comprising a second exercise ball body, having a second opening and a rotor, wherein the second opening is disposed at a side of the second exercise ball body, and the other side of the second exercise ball body is connected to an end of the handle where the first exercise ball body is disposed.

3. The wrist exerciser with the handle according to claim 1, further comprising a base body, connected to the other side of the handle where the first exercise ball body is disposed.

4. The wrist exerciser with the handle according to claim 1, wherein the handle is integrally formed on and connected to the first exercise ball body.

5. The wrist exerciser with the handle according to claim 1, wherein the handle has a screw-tooth structure, the first exercise ball body has a screw-thread structure, and the screw-tooth structure is screwed with the screw-thread structure, so that the handle is firmly disposed at the first exercise ball body.

6. The wrist exerciser with the handle according to claim 1, further comprising a second exercise ball body and a second connection member, wherein the second exercise ball body has a second opening and a rotor, the second opening is disposed at a side of the second exercise ball body, the second connection member comprises a second connection portion and a second locking portion, the second connection portion is connected to a side of the second exercise ball body other than the side on which the second opening is disposed, and the bottom of the plunger is inserted to the second connection portion and is firmly combined with the second locking portion.

7. The wrist exerciser with the handle according to claim 3, wherein the first exercise ball body further has a sensor module, for sensing a rotating status of the rotor to output movement data information.

8. The wrist exerciser with the handle according to claim 7, wherein the base body has a cover body having a hollow window, an accommodation space is formed inside the cover body and the base body, an electronic module is disposed inside the accommodation space, an output module is embedded in the hollow window and is electrically connected to the electronic module, and after receiving the movement data information, the electronic module transmits the movement data information to the output module.

9. The wrist exerciser with the handle according to claim 8, wherein the electronic module comprises a transmission module exchanging data with an external data terminal equipment, and the transmission module is a Universal Serial Bus (USB) transmission module, an Ethernet transmission module, an Institute of Electrical and Electronics Engineers 802 (IEEE 802) standard wireless transmission module, a Zigbee or a Bluetooth transmission module.

10. A wrist exerciser with a handle, comprising:

a first exercise ball body, having a first opening, a rotor, and a first hold position driving the rotor to rotate, wherein the first opening is disposed at a side of the first exercise ball body, and the rotor is disposed inside the first exercise ball body;

a handle, connected to the other side of the first exercise ball body where the first opening is disposed, being coaxially corresponding to the first opening, and having a second hold position driving the rotor to rotate;

the handle comprises: a first connection member, comprising a first connection portion and a first locking portion, wherein the first connection portion is connected to the other side of the first exercise ball body other than the side on which the first opening is disposed and a plunger, having a top and a bottom, wherein the top is inserted to the first connection portion, and is firmly combined with the first locking portion; and a second exercise ball body and a second connection member, wherein the second exercise ball body has a second opening and a rotor, the second opening is disposed at a side of the second exercise ball body, the second connection member comprises a second connection portion and a second locking portion, the second connection portion is connected to a side of the second exercise ball body other than the side on which the second opening is disposed, and the bottom of the plunger is inserted to the second connection portion and is firmly combined with the second locking portion, an edge of the bottom of the plunger has two outward protrusions, the second locking portion has two longitudinal guide rails corresponding to the two outward protrusions, and two grooves facing each other and disposed between the two longitudinal guide rails, and the corresponding protrusion is inserted to each longitudinal guide rail, so that the two protrusions are snapped in the two grooves from a bottom of the second locking portion through the two longitudinal guide rails.

* * * * *